US008150042B2

(12) United States Patent
Van Loon et al.

(10) Patent No.: US 8,150,042 B2
(45) Date of Patent: Apr. 3, 2012

(54) METHOD, DEVICE, ENCODER APPARATUS, DECODER APPARATUS AND AUDIO SYSTEM

(75) Inventors: Machiel Willem Van Loon, Eindhoven (NL); Dirk Jeroen Breebaart, Eindhoven (NL); Gerard Herman Hotho, Eindhoven (NL); Erik Gosuinus Petrus Schuijers, Eindhoven (NL); Heiko Purnhagen, Sundbyberg (SE); Karl Jonas Roden, Solna (SE)

(73) Assignees: Koninklijke Philips Electronics N.V., Eindhoven (NL); Coding Technologies AB, Stockholm (SE)

( * ) Notice: Subject to any disclaimer, the term of this patent is extended or adjusted under 35 U.S.C. 154(b) by 1461 days.

(21) Appl. No.: 11/571,840

(22) PCT Filed: Jul. 7, 2005

(86) PCT No.: PCT/IB2005/052254

§ 371 (c)(1),
(2), (4) Date: Jan. 9, 2007

(87) PCT Pub. No.: WO2006/008683

PCT Pub. Date: Jan. 26, 2006

(65) Prior Publication Data

US 2007/0230710 A1 Oct. 4, 2007

(30) Foreign Application Priority Data

Jul. 14, 2004 (EP) ..... 04103365

(51) Int. Cl.
*H04R 5/00* (2006.01)

(52) U.S. Cl. ..... 381/23; 381/22

(58) Field of Classification Search ..... 381/1, 17, 381/23, 20, 19, 21, 22; 704/500, 501; 341/50, 341/51

See application file for complete search history.

(56) References Cited

U.S. PATENT DOCUMENTS 5,701,346 A 12/1997 Herre et al.

(Continued)

FOREIGN PATENT DOCUMENTS

EP 0858243 A2 8/1998

(Continued)

OTHER PUBLICATIONS

ISR: PCT/IB2005/052254.

(Continued)

*Primary Examiner* — Hai Phan

(74) *Attorney, Agent, or Firm* — Michael A. Glenn; Glenn Patent Group

(57) ABSTRACT

Techniques are described for combining parametric multi-channel audio coding with matrixing, reconstructing a full-quality multi-channel, independent of the decoder. A stereo signal is obtained from encoding an N-channel audio signal into spatial parameters and a stereo down-mix signal having first and second stereo signals, including adding a first signal and a third signal to obtain a first output signal, the first signal having the first stereo signal modified by a first complex function, the third signal having the second stereo signal modified by a third complex function. A second signal and fourth signal are similarly added to obtain a second output signal. Complex functions are chosen such that an energy value of the difference between first signal and the second signals (fourth signal and third signals) is larger than or equal to the energy value of the sum of the first and the second signal (fourth signal and third signal).

17 Claims, 3 Drawing Sheets

U.S. PATENT DOCUMENTS

| | | | | |
|---|---|---|---|---|
| 5,771,295 | A | 6/1998 | Waller, Jr. | |
| 5,812,971 | A | 9/1998 | Herre | |
| 5,818,941 | A | 10/1998 | Embree | |
| 6,111,958 | A * | 8/2000 | Maher | 381/17 |
| 6,198,827 | B1 | 3/2001 | Waller, Jr. | |
| 6,539,357 | B1 | 3/2003 | Sinha | |
| 6,697,491 | B1 * | 2/2004 | Griesinger | 381/20 |
| 7,212,872 | B1 | 5/2007 | Smith et al. | |
| 7,391,870 | B2 | 6/2008 | Herre et al. | |
| 7,440,575 | B2 * | 10/2008 | Kirkeby | 381/1 |
| 7,447,629 | B2 * | 11/2008 | Breebaart | 704/219 |
| 7,720,231 | B2 * | 5/2010 | Breebaart | 381/23 |
| 2003/0210794 | A1 | 11/2003 | Sato et al. | |
| 2004/0032960 | A1 | 2/2004 | Griesinger | |
| 2006/0004583 | A1 * | 1/2006 | Herre et al. | 704/500 |
| 2011/0058679 | A1 | 3/2011 | Van Loon et al. | |

FOREIGN PATENT DOCUMENTS

| | | | |
|---|---|---|---|
| JP | 09-289700 | | 4/1997 |
| JP | 2003-533154 | | 5/2003 |
| JP | 2008-505368 | | 2/2008 |
| JP | 2004-78183 | | 3/2011 |
| WO | 0004744 | A1 | 1/2000 |
| WO | WO2004/008805 | | 1/2004 |
| WO | 2005098826 | A1 | 10/2005 |

OTHER PUBLICATIONS

Written Opinion: PCT/IB2005/052254.

* cited by examiner

METHOD, DEVICE, ENCODER APPARATUS, DECODER APPARATUS AND AUDIO SYSTEM

The invention relates to a method and a device for processing a stereo signal obtained from an encoder, which encodes an N-channel audio signal into spatial parameters and a stereo down-mix signal comprising first and second stereo signals. The invention also relates to an encoder apparatus comprising such an encoder and such a device.

The invention also relates to a method and a device for processing a stereo down-mix signal obtained by such a method and a device for processing a stereo signal obtained from an encoder. The invention also relates to a decoder apparatus comprising such a device for processing a stereo down-mix signal.

The invention also relates to an audio system comprising such an encoder apparatus and such a decoder apparatus.

For a long time, stereo reproduction of music, for example, in the home environment has been prevailing. During the 1970s, some experiments were done with four-channel reproduction of home music equipment.

In larger halls, such as film theatres, multi-channel reproduction of sound has been present for a long time. Dolby Digital® and other systems were developed for providing realistic and impressive sound reproduction in a large hall.

Such multi-channel systems have been introduced in the home theatre and are gaining wide interest. Thus, systems having five full-range channels and one part-range channel or low-frequency effects (LFE) channel, referred to as 5.1 systems, are common on the market today. Other systems also exist, such as 2.1, 4.1, 7.1 and even 8.1.

With the introduction of SACD and DVD, multi-channel audio reproduction is gaining ground. Many consumers already have the possibility of multi-channel playback in their homes, and multi-channel source material is becoming popular. However, many people still have only 2-channel reproduction systems, and transmission usually takes place via 2 channels. For this reason, matrixing techniques like e.g. Dolby Surround® were developed, to make transmission of multi-channel audio via 2 channels possible. The transmitted signal can be played back directly with a 2-channel reproduction system. When an appropriate decoder is available, multi-channel playback is possible. Well-known decoders for this purpose are Dolby Pro Logic® (I and II), (Kenneth Gundry, "A new active matrix decoder for surround sound", In Proc. AES 19th International Conference on Surround Sound, June 2001) and Circle Surround® (I and II) (U.S. Pat. No. 6,198,827: 5-2-5 matrix system).

Because of the increased popularity of multi-channel material, efficient coding of multi-channel material is becoming more important. Matrixing reduces the number of audio channels required for transmission and thus reduces the required bandwidth or bit rate. An extra advantage of the matrix technique is that it is backward compatible with stereo reproduction systems. For further reduction of the bit rate, a conventional audio coder can be applied to encode the matrixed stereo signal.

Another possibility to reduce the bit rate is by encoding all the individual channels without matrixing. This method results in a higher bit rate, because five channels have to be encoded instead of two, but the spatial reconstruction can be much closer to the original than by applying matrixing.

In principle, the matrixing process is a lossy operation. Therefore, perfect reconstruction of the 5 channels from only a 2-channel mix is generally impossible. This property limits the maximum perceptual quality of the 5-channel reconstruction.

Recently, a system has been developed that encodes multi-channel audio as a 2-channel stereo audio signal and a small number of spatial parameters or encoder information parameters P. Consequently, this system is backward compatible for stereo reproduction. The transmitted spatial parameters or encoder information parameters P determine how the decoder should reconstruct five channels from the available two-channel stereo down-mix signal. Due to the fact that the up-mix process is controlled by transmitted parameters, the perceptual quality of the 5-channel reconstruction improves considerably as compared to up-mix algorithms without controlling parameters (e.g., Dolby Pro Logic).

In summary, three different methods can be applied to generate a 5-channel reconstruction from a provided two-channel mix:

1) Blind reconstruction. This method tries to estimate the up-mix matrix based on signal properties only, without any provided information.
2) Matrixing techniques, e.g. Dolby Pro Logic. By applying a certain down-mix matrix, the reconstruction from 2 to 5 channels can be improved due to certain signal properties that are determined by the applied down-mix matrix.
3) Parameter-controlled up-mix. In this method, the encoder information parameters P are typically stored in ancillary parts of a bit stream, ensuring backward compatibility with normal stereo playback systems. However, these systems are generally not backward compatible with matrixing systems.

It may be of interest to combine methods 2 and 3 mentioned above to a single system. This ensures maximum quality, dependent on the available decoder. For consumers who have a matrix surround decoder, such as Dolby Pro Logic or Circle Surround, a reconstruction is obtained in accordance with the matrix process. If a decoder is available that is able to interpret the transmitted parameters, a higher quality reconstruction can be obtained. Consumers who do not have a matrix surround decoder or a decoder that can interpret the spatial parameters can still enjoy the stereo backward compatibility. However, one problem of combining methods 2 and 3 is that the actual transmitted stereo down-mix will be modified. This, in turn, might have an adverse effect on the 5-channel reconstruction using the spatial parameters.

It is an object of the invention to provide a method allowing combination of parametric multi-channel audio coding with matrixing techniques, with which method a full-quality multi-channel reconstruction can be realized, independent of the available decoder.

According to the invention, this object is achieved by means of a method of processing a stereo signal obtained from an encoder, which encodes an N-channel audio signal into spatial parameters and a stereo down-mix signal comprising first and second stereo signals, the method comprising the steps of:

adding a first signal and a third signal to obtain a first output signal, wherein said first signal comprises said first stereo signal modified by a first complex function, and wherein said third signal comprises said second stereo signal modified by a third complex function; and adding a second signal and a fourth signal to obtain a second output signal, wherein said fourth signal comprises said second stereo signal modified by a fourth complex function and wherein said second signal comprises said first stereo signal modified by a second complex function;

wherein said complex functions are functions of said spatial parameters and are chosen to be such that an energy value of the difference between the first signal and the second signal is larger than or equal to the energy value of the sum of the first and the second signal, and such that the energy value of the difference between the fourth signal and the third signal is larger than or equal to the energy value of the sum of the fourth signal and the third signal. Accordingly, front/back steering in the decoder is enabled.

The energy value of these difference and sum signals may be based on the 2-norm (i.e. sum of squares over a number of samples) or the absolute value of these signals. Also other conventional energy measures may be applied here.

In an embodiment of the invention, the N-channel audio signal comprises front-channel signals and rear-channel signals, and said spatial parameters comprise a measure of the relative contribution of the rear channels in the stereo down-mix as compared to the contribution of the front channels therein. This is because selection of rear-channel contribution is necessary.

The magnitude of said second complex function may be smaller than the magnitude of said first complex function to enable left/right rear steering and/or the magnitude of said third complex function is smaller than the magnitude of said fourth complex function.

The second complex function and/or the third complex function may comprise a phase shift, which is substantially equal to plus or minus 90 degrees in order to prevent signal cancellation with front channel contribution.

In another embodiment of the invention, said first function comprises first and second function parts, wherein the output of said second function part increases when said spatial parameters indicate that a contribution of the rear channels in said first stereo signal increases as compared to the contribution of the front channels, and said second function part comprises a phase shift which is substantially equal to plus or minus 90 degrees. This is to prevent signal cancellation with front channels. Moreover, said fourth function may comprise third and fourth function parts, wherein the output of said fourth function part increases when said spatial parameters indicate that the contribution of the rear channels in said second stereo signal increases as compared to the contribution of the front channels, and said fourth function part comprises a phase shift which is substantially equal to plus or minus 90 degrees.

The first function part may have an opposite sign as compared to said fourth function part. The second function may have an opposite sign as compared to said third function. The second function and the fourth function part may have the same sign, and the third function and the second function part may have the same sign.

In another aspect of the invention, a device is provided for processing a stereo signal in accordance with the above-mentioned methods, and an encoder apparatus comprising such a device.

In another aspect of the invention, a method is provided for processing a stereo down-mix signal comprising first and second stereo signals, the method comprising the step of inverting the processing operation in accordance with the above-mentioned methods.

In another aspect of the invention, a device is provided for processing a stereo down-mix signal in accordance with the above-mentioned method of processing a stereo down-mix signal, and a decoder apparatus comprising such a device.

In yet another aspect of the invention, an audio system is provided, comprising such an encoder apparatus and such a decoder apparatus.

Further objects, features and advantages of the invention will appear from the following detailed description of the invention with reference to embodiments thereof and to the appended drawings, in which.

The inventive method is able to make matrix decoding possible without degrading the parametric multi-channel reconstruction. That is possible because the matrixing techniques are applied in the encoder after down-mixing, in contradiction with usual matrixing, which is done before down-mixing. The matrixing of the down-mix is controlled by the spatial parameters.

If the applied matrix is invertible, the decoder can undo the matrixing based on the transmitted encoder information parameters P.

Conventionally, matrixing is applied on the original N-channel input signal. However, this approach is not suitable here, since inversion of this matrixing, which is a prerequisite for correct N-channel reconstruction, is generally impossible, because only 2 channels are available at the decoder. Thus, one feature of this invention is to replace the matrixing technique, which is normally applied on the 5-channel mix, by a parameter-controlled modification of the two-channel mix.

Figure 1:
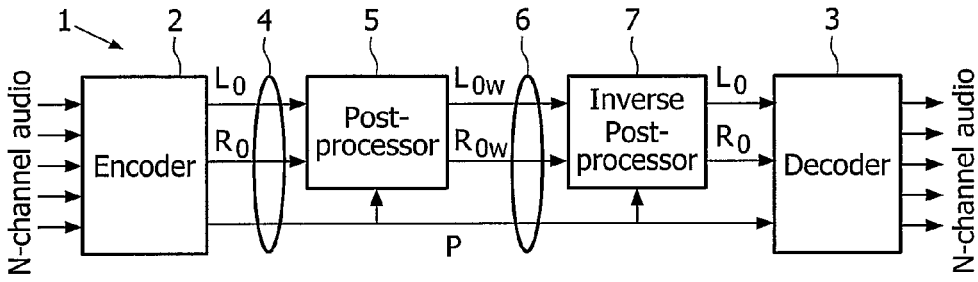
FIG. 1 is a block diagram of an encoder/decoder audio system including post-processing and inverse post-processing according to the invention.

FIG. 1 is a block diagram of an encoder/decoder audio system incorporating the invention. In the audio system 1, an N-channel audio signal is supplied to an encoder 2. The encoder 2 transforms the N-channel audio signal to stereo channel signals $L_0$ and $R_0$ and encoder information parameters P, by means of which a decoder 3 can decode the information and approximately reconstruct the original N-channel signal to be output from the decoder 3. The N-channel signals may be signals for a 5.1 system, comprising a center channel, two front channels, two surround channels and a Low Frequency Effects (LFE) channel.

Conventionally, the encoded stereo channel signals $L_0$ and $R_0$ and encoder information parameters P are transmitted or distributed to the user in a suitable way, such as by CD, DVD, broadcast, laser disc, DBS, digital cable, Internet or any other transmission or distribution system, indicated by the circle 4 in FIG. 1. Since the left and right stereo signals $L_0$ and $R_0$ are transmitted or distributed, the system 1 is compatible with the vast number of receiving equipment that can only reproduce stereo signals. If the receiving equipment includes a parametric multi-channel decoder, the decoder may decode the N-channel signals by providing an estimate thereof on the basis of the information in the stereo channels $L_0$ and $R_0$ as well as the encoder information parameters P.

Now, assume an N-channel audio signal, with N being an integer which is larger than 2, and where $z_1[n]$, $z_2[n]$, . . . , $z_N[n]$ describe the discrete time-domain waveforms of the N channels. These N signals are segmented by using a common segmentation, preferably using overlapping analysis windows. Subsequently, each segment is converted to the frequency domain, using a complex transform (e.g. FFT). However, complex filter-bank structures may also be appropriate to obtain time/frequency tiles. This process results in segmented, sub-band representations of the input signals, which will be denoted by $Z_1[k], Z_2[k], \ldots, Z_N[k]$ with k denoting the frequency index.

From these N channels, 2 down-mix channels are created, namely $L_O[k]$ and $R_O[k]$. Each down-mix channel is a linear combination of the N input signals:

$$L_0[k] = \sum_{i=1}^{N} \alpha_i Z_i[k]$$

$$R_0[k] = \sum_{i=1}^{N} \beta_i Z_i[k]$$

The parameters $\alpha_i$ and $\beta_i$ are chosen to be such that the stereo signal consisting of $L_O[k]$ and $R_O[k]$ has a good stereo image.

On the resulting stereo signal, a post-processor 5 can apply processing in such a way that it mainly affects the contribution of a specific channel i in the stereo mix. As processing, a specific matrixing technique can be chosen. This results in the left and right matrix-compatible signals $L_{Ow}[k]$ and $R_{Ow}[k]$. These, together with the spatial parameters are transmitted to the decoder as illustrated by the circle 6 in FIG. 1. The device for processing a stereo signal obtained from an encoder comprises the post-processor 5. The encoder apparatus according to the invention comprises the encoder 2 and the post-processor 5.

The post-processed signals $L_{0w}$ and $R_{0w}$ may be supplied to a conventional stereo receiver (not shown) for playback. Alternatively, the post-processed signals $L_{0w}$ and $R_{0w}$ may be supplied to a matrix decoder (not shown), e.g. a Dolby Pro Logic® decoder or a Circle Surround® decoder. Yet another possibility is to supply the post-processed signals $L_{0w}$ and $R_{0w}$ to an inverse post-processor 7 for undoing the processing of the post-processor 5. The resulting signals $L_0$ and $R_0$ can be supplied by the post-processor 7 to a multi-channel decoder 3. The device for processing a stereo down-mix signal comprises the inverse post-processor 7. The decoder apparatus according to the invention comprises the decoder 3 and the inverse post-processor 7.

In the decoder 3, the N input channels are reconstructed as follows:

$$\hat{Z}_i[k]=C_{1,Z_i}L_O[k]+C_{2,Z_i}R_O[k],$$

where $\hat{Z}_i[k]$ is an estimate of $Z_i[k]$. The filters $C_{1,Z_i}$ and $C_{2,Zi}$ are preferably time and frequency-dependent, and their transfer functions are derived from the transmitted encoder information parameters P.

Figure 2:
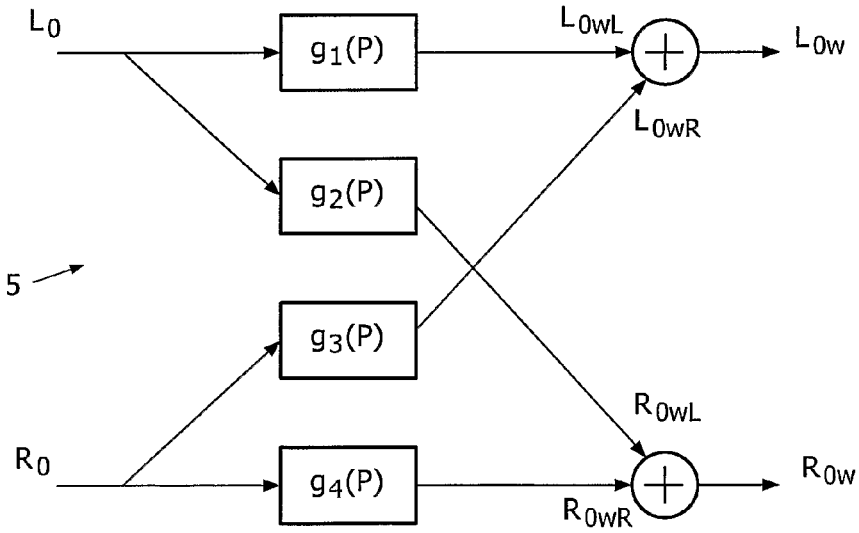
FIG. 2 is a block diagram of an embodiment of a device for processing a stereo signal in accordance with the invention.

FIG. 2 shows how this post-processing block 5 may be embodied to make matrix decoding possible. The left input signal $L_O[k]$ is modified by a first complex function $g_1$, which results in a first signal $L_{OwL}[k]$ which is fed to the left output $L_{Ow}[k]$. The left input signal $L_O[k]$ is also modified by a second complex function $g_2$, which results in a second signal $R_{OwL}[k]$ which is fed to the right output $R_{Ow}V[k]$. The functions $g_1$ and $g_2$ are chosen to be such that the difference signal $L_{OwL}-R_{OwL}$ has an equal or larger energy than the sum signal $L_{OwL}+R_{OwL}$. This is because, in the matrix decoding, the ratio of the sum and difference signal is used to perform front/back steering. When the difference signal becomes larger, more input signal is steered to the rear. Because of this $R_{OwL}[k]$ has to increase when the contribution of the left rear in $L_O[k]$ increases. This control procedure is done by the functions $g_1$ and $g_2$, which are both functions of the spatial parameters P. These functions are chosen, such that the amount of processing of the left input channel increases when the contribution of the left rear in $L_O[k]$ increases.

The magnitude of $g_2$ is preferably smaller than the magnitude of $g_1$. This allows left/right rear steering in the decoder.

The right input signal $R_O[k]$ is modified by a fourth function $g_4$, which results in a fourth signal $R_{OwR}[k]$, which is fed to the right output $R_{Ow}[k]$. The right input signal $R_O[k]$ is also modified by a third function $g_3$, which results in a third signal $L_{OwR}[k]$, which is fed to the left output $L_{Ow}[k]$. The functions $g_3$ and $g_4$ are chosen, such that the amount of processing of the right input channel increases when the contribution of the right rear in $R_O[k]$ increases, and also such that subtracting $L_{0wR}$ from $R_{0wR}$ results in a larger signal than adding them.

The magnitude of $g_3$ is preferably smaller than the magnitude of $g_4$. This allows left/right rear steering in the decoder.

The output can be described by means of the following matrix equation:

$$\begin{bmatrix} L_{ow} \\ R_{ow} \end{bmatrix} = H\begin{bmatrix} L_0 \\ R_0 \end{bmatrix} = \begin{bmatrix} g_1 & g_3 \\ g_2 & g_4 \end{bmatrix}\begin{bmatrix} L_0 \\ R_0 \end{bmatrix}$$

A parametric multi-channel encoder is described below. The following equations are applied:

$$L_0[k]=L[k]+C_s[k]$$

$$R_0[k]=R[k]+C_s[k]$$

in which $C_s[k]$ is the mono signal that results after combining the LFE channel and center channel. The following equations holds for L[k] and R[k]:

$$L[k] = (\, c_1 \quad c_2 \,)\begin{pmatrix} L_f[k] \\ L_s[k] \end{pmatrix}$$

$$R[k] = (\, c_3 \quad c_4 \,)\begin{pmatrix} R_f[k] \\ R_s[k] \end{pmatrix}$$

where $L_f$ is the left-front, $L_s$ the left-surround, $R_f$ the right-front and $R_s$ the right-surround channel. The constants $c_1$ to $c_4$ control the down-mix process and may be complex-valued and/or time and frequency-dependent. An ITU-style down-mix is obtained for ($c_1$, $c_3$=sqrt(2); $c_2$, $c_4$=1).

In the decoder, the following reconstruction is performed:

$$\hat{L}[k]=\beta L_0[k]+(\gamma-1)R_0[k]$$

$$\hat{R}[k]=(\beta-1)L_0[k]+\gamma R_0[k]$$

$$\hat{C}[k]=(1-\beta)L_0[k]+(1-\gamma)R_0[k]$$

where $\hat{L}[k]$ is an estimate of L[k], $\hat{R}[k]$ an estimate of R[k] and $\hat{C}[k]$ an estimate of $C_s[k]$. The parameters β and γ are determined in the encoder and transmitted to the decoder, i.e. they are a subset of the encoder information parameters P. Additionally, the information signal P may include (relative) signal levels between corresponding front and surround channels, i.e. an Inter-channel Intensity Difference (IID) between $L_f$, $L_s$, and $R_f$, $R_s$, respectively. A convenient expression for the $IID_1$, describing the energy ratio between $L_f$ and $L_s$ is given by $$IID_L = \frac{\sum_k L_f[k]L_f^*[k]}{\sum_k L_s[k]L_s^*[k]}$$

Figure 3:
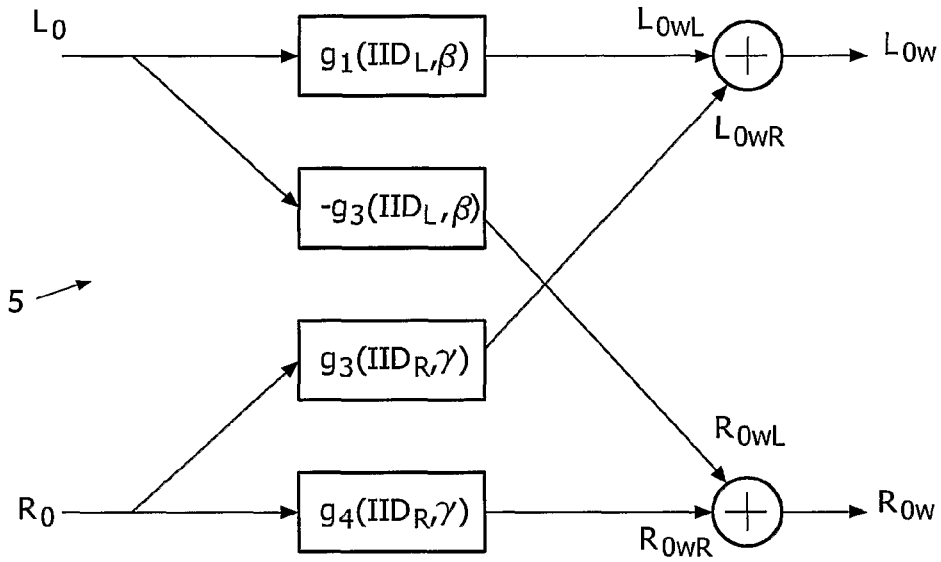
FIG. 3 is a detailed block diagram similar to FIG. 2, showing further details of the invention.

When these parameters are used, the scheme in FIG. 2 can be replaced by the scheme in FIG. 3. For processing the left channel $L_O[k]$, only the parameters are necessary that determine the front/back contribution in the left input channel, which are the parameters $IID_L$ and $\beta$. For processing of the right input channel, only the parameters $IID_R$ and $\gamma$ are necessary. The function $g_2$ can now be replaced by the function $g_3$, but with an opposite sign.

Figure 4:
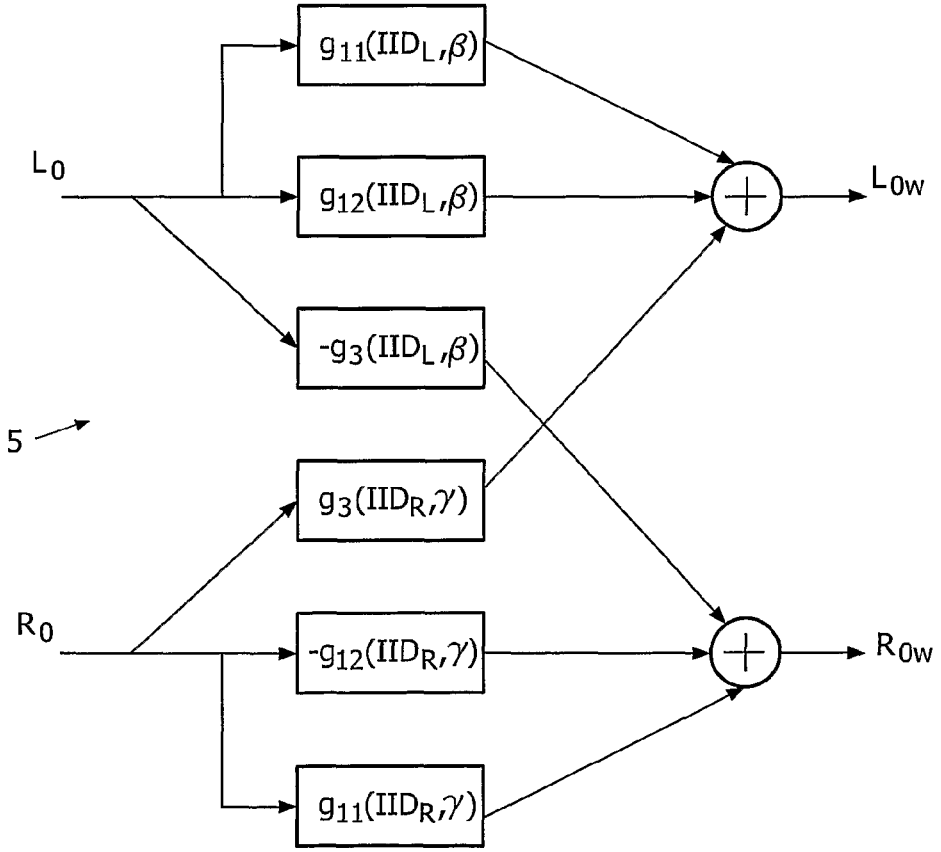
FIG. 4 is a detailed block diagram similar to FIG. 3, showing still further details of the invention.

In FIG. 4, functions $g_1$ and $g_4$ are both split into two parallel function parts. The function $g_1$ is split into $g_{11}$ and $g_{12}$. The function $g_4$ is split into $g_{11}$ and $-g_{12}$. The output signals of the function part $g_{12}$ and the function $g_3$ are the contributions of the rear channels. The function part $g_{12}$ and the function $g_3$ need to be added with the same sign in one output so as to prevent signal cancellation and with opposite sign in the different outputs.

The function part $g_{12}$ and the function $g_3$ both contain a phase shift of plus or minus 90 degrees. This is to prevent cancellation of the front channel contribution (output of function part $g_{11}$).

Figure 5:
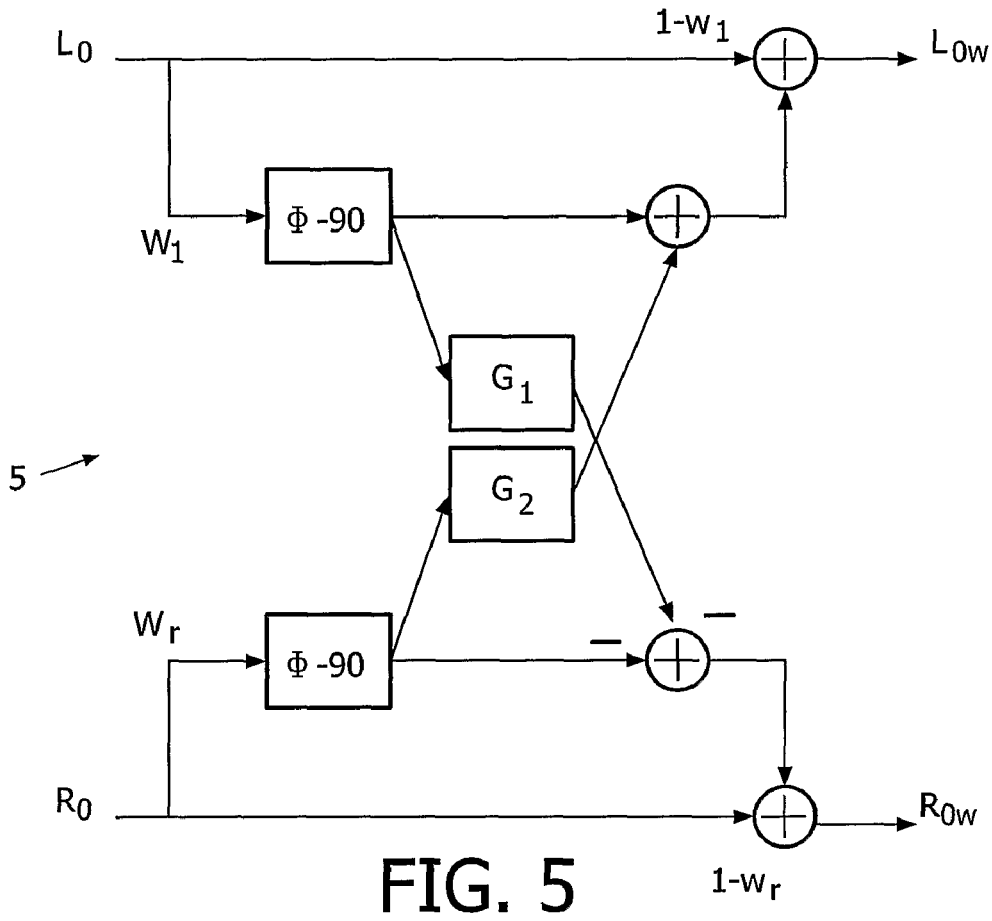
FIG. 5 is a detailed block diagram similar to FIG. 3, showing yet further details of the invention.

FIG. 5 gives a more detailed description of this block. The parameter $w_1$ determines the amount of processing of $L_O[k]$ and $w_r$ of $R_O[k]$. When $w_1$ is equal to 0, $L_O[k]$ is not processed, and when $w_1$ is equal to 1, $L_O[k]$ is maximally processed. The same holds for $w_r$ with respect to $R_O[k]$.

The following generalized equations hold for the post-processing parameters $w_1$ and $w_r$:

$$w_1 = f_1(p)$$

$$w_r = f_r(p)$$

The blocks $\Phi^{-90}$ are all-pass filters that perform a 90-degree phase shift. The blocks $G_1$ and $G_2$ in FIG. 5 are gains. The resulting outputs are:

$$\begin{bmatrix} L_{0w} \\ R_{0w} \end{bmatrix} = H \begin{bmatrix} L_0 \\ R_0 \end{bmatrix}, \text{ with:,}$$

$$H = \begin{bmatrix} 1 - w_l + w_l\Phi^{-90} & w_r\Phi^{-90}G_2 \\ -w_l\Phi^{-90}G_1 & 1 - w_r - w_r\Phi^{-90} \end{bmatrix}$$

where:

$$G_1 = f_1(w_1, w_r)$$

$$G_2 = f_2(w_1, w_r)$$

So the functions $g_1 \ldots g_4$ are replaced by more specific functions:

$$g_1 = 1 - w_1 + w_1\Phi^{-90}$$

$$g_2 = -w_1\Phi^{-90}G_1$$

$$g_3 = w_r\Phi^{-90}G_2$$

$$g_4 = 1 - w_r = w_r\Phi^{-90}$$

The inverse of the matrix H is given by (if $\det(H) \neq 0$):

$$H^{-1} = \frac{1}{\begin{array}{c} 1 - w_l - w_r + w_l w_r + \\ (w_l - w_r)\Phi^{-90} + \\ (G_1 G_2 - 1) w_l w_r \Phi^{-180} \end{array}} \begin{bmatrix} 1 - w_r - w_r\Phi^{-90} & -w_r\Phi^{-90}G_2 \\ w_l\Phi^{-90}G_1 & 1 - w_l + w_l\Phi^{-90} \end{bmatrix}$$

Hence, usage of suitable functions in the matrix H allows the matrixing process to be inverted.

The inversion can be done in the decoder without the necessity to transmit additional information, because the parameters $w_1$ and $W_r$ can be calculated from the transmitted parameters. Thus, the original stereo signal will be available again which is necessary for parametric decoding of the multichannel mix.

Even better results can be achieved if the gains $G_1$ and $G_2$ are a function of the inter-channel intensity difference (IID) between the surround channels. In that case, this IID has to be transmitted to the decoder as well.

Given the above-mentioned parameter description, the following functions are used for the post-processing operation:

$$w_1 = f_1(\alpha_1) f_2(\beta)$$

$$w_r = f_3(\alpha_r) f_4(\gamma)$$

Here $f_1 \ldots f_4$ may be arbitrary functions. For example:

$$f_1(IID) = f_3(IID) = \frac{IID}{1 + IDD}$$

$$f_2(\beta) = f_4(\beta) = \begin{cases} 2\beta - 1 & \text{if } 0.5 < \beta < 1 \\ 1 & \text{if } \beta \geq 1 \\ 0 & \text{if } \beta \leq 0.5 \end{cases}$$

The all-pass filter $\Phi^{-90}$ can be efficiently realized by performing a multiplication in the (complex-valued) frequency domain with the complex operator j ($j^2 = -1$). For the gains $G_1$ and $G_2$ a function of $w_1$, $w_r$ can be taken as is done in Circle Surround, but also a constant is suitable with the value $1/\sqrt{2}$. This results in the matrix:

$$H = \begin{pmatrix} 1 - w_l + w_l j & \frac{1}{2}\sqrt{2w_r j} \\ -\frac{1}{2}\sqrt{2w_r j} & 1 - w_r - w_r j \end{pmatrix}$$

The determinant of this matrix is equal to:

$$\det(H) = \left(1 - w_l - w_r + \frac{3}{2} w_l w_r\right) + j(w_l - w_r)$$

The imaginary part of this determinant will only be equal to zero when $w_1 = w_r$. In that case, the following holds for the determinant:

$$\det(H) = 1 - 2w_l + \frac{3}{2} w_l^2$$

This function has a minimum of $$\det(H) = \frac{1}{3} \text{ for } w_l = \frac{2}{3}.$$

Consequently, also for $w_l = w_r$ this matrix is invertible. Hence for gains $G_1 = G_2 = 1/\sqrt{2}$ the matrix H is always invertible, independent of the values $w_1$ and $w_r$.

Figure 6:
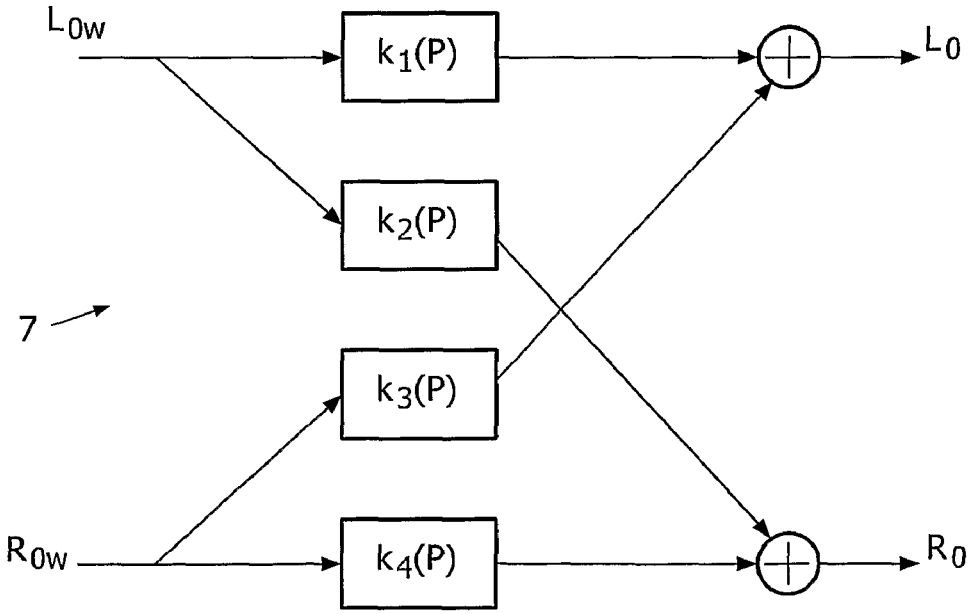
FIG. 6 is a block diagram of an embodiment of a device for processing a stereo down-mix signal in accordance with the invention.

FIG. 6 is a block diagram of an embodiment of the inverse post-processor 7. Like the post-processing, the inversion is done by a matrix multiplication for each frequency band:

$$\begin{bmatrix} L_0 \\ R_0 \end{bmatrix} = H^{-1} \begin{bmatrix} L_{0w} \\ R_{0w} \end{bmatrix} = \begin{bmatrix} k_1 & k_3 \\ k_2 & k_4 \end{bmatrix} \begin{bmatrix} L_{0w} \\ R_{0w} \end{bmatrix}$$

with $$k_1 = \frac{1}{g_1 g_4 - g_2 g_3} g_4$$

$$k_2 = \frac{-1}{g_1 g_4 - g_2 g_3} g_2$$

$$k_3 = \frac{-1}{g_1 g_4 - g_2 g_3} g_3$$

$$k_4 = \frac{1}{g_1 g_4 - g_2 g_3} g_1$$

Consequently, when the functions $g_1 \ldots g_4$ can be determined in the decoder, the functions $k_1 \ldots k_4$ can be determined. The functions $k_1 \ldots k_4$ are functions of the parameter set P, like the functions $g_1 \ldots g_4$. For inversion, the functions $g_1 \ldots g_4$ and the parameter set P therefore need to be known.

The matrix H can be inverted when the determinant of the matrix H is unequal to zero, i.e.:

$$\det(H) = g_1 g_4 - g_2 g_3 \neq 0$$

This can be achieved by a proper choice of the functions $g_1 \ldots g_4$.

Another application of the invention is to perform the post-processing operation on the stereo signal at the decoder side only (i.e. without post-processing at the encoder side). Using this approach, the decoder can generate an enhanced stereo signal from a non-enhanced stereo signal. This post-processing operation on the decoder side only may be further elaborated in a situation in which, in the encoder, the multichannel input signal is decoded into a single (mono) signal and associated spatial parameters. In the decoder, the mono signal may first be converted into a stereo signal (using the spatial parameters) and thereafter this stereo signal may be post-processed as described above. Alternatively, the mono signal may be decoded directly by a multichannel decoder.

It is to be noted that use of the verb "comprise" and its conjugations does not exclude other elements or steps and that use of the indefinite article "a" or "an" does not exclude a plurality of elements or steps. Moreover, reference signs in the claims shall not be construed as limiting the scope of the claims.

The invention has been described with reference to specific embodiments. However, the invention is not limited to the various embodiments described but may be amended and combined in different manners as is apparent to a skilled person reading the present specification.

The invention claimed is:

1. A method of processing a stereo down-mix signal comprising first and second stereo signals, the stereo down-mix signal and associated spatial parameters encoding an N-channel audio signal, the method comprising:

adding a first signal and a third signal to obtain a first output signal, wherein said first signal comprises said first stereo signal modified by a first complex function, and wherein said third signal comprises said second stereo signal modified by a third complex function; and adding a second signal and a fourth signal to obtain a second output signal, wherein said fourth signal comprises said second stereo signal modified by a fourth complex function and wherein said second signal comprises said first stereo signal modified by a second complex function;

wherein said complex functions are functions of said spatial parameters and are chosen to be such that an energy value of the difference between the first signal and the second signal is larger than or equal to the energy value of the sum of the first and the second signal, and such that the energy value of the difference between the fourth signal and the third signal is larger than or equal to the energy value of the sum of the fourth signal and the third signal.

2. The method as claimed in claim 1, wherein the N-channel audio signal comprises front-channel signals and rear-channel signals, and wherein said spatial parameters comprise a measure of the relative contribution of the rear channels in the stereo down-mix as compared to the contribution of the front channels therein.

3. The method as claimed in claim 1, wherein the magnitude of said second complex function is smaller than the magnitude of said first complex function or the magnitude of said third complex function is smaller than the magnitude of said fourth complex function.

4. The method as claimed in claim 1, wherein said second complex function comprises a phase shift which is substantially equal to plus or minus 90 degrees with respect to said first stereo signal or said third complex function comprises a phase shift which is substantially equal to plus or minus 90 degrees with respect to said second stereo signal.

5. The method as claimed in claim 1, wherein said first complex function comprises first and second function parts, wherein the output of said second function part increases when said spatial parameters indicate that a contribution of the rear channels in said first stereo signal increases as compared to the contribution of the front channels in said first stereo signal, and said second function part comprises a phase shift which is substantially equal to plus or minus 90 degrees with respect to said first stereo signal.

6. The method as claimed in claim 5, wherein said fourth complex function comprises third and fourth function parts, wherein the output of said fourth function part increases when said spatial parameters indicate that the contribution of the rear channels in said second stereo signal increases as compared to the contribution of the front channels in said second stereo signal, and said fourth function part comprises a phase shift which is substantially equal to plus or minus 90 degrees with respect to said second stereo signal.

7. The method as claimed in claim 6, wherein said first function part has an opposite sign as compared to said fourth function part.

8. The method as claimed in claim 6, wherein said second complex function has an opposite sign as compared to said third complex function.

9. The method as claimed in claim 7, wherein said second complex function and said fourth function part have the same sign, and wherein said third complex function and said second function part have the same sign.

10. A device for processing a stereo down-mix signal comprising first and second stereo signals, the stereo down-mix signal and associated spatial parameters encoding an N-channel audio signal, the device comprising:

a first adder for adding a first signal and a third signal to obtain a first output signal, wherein said first signal comprises said first stereo signal modified by a first complex function, and wherein said third signal comprises said second stereo signal modified by a third complex function; and a second adder for adding a second signal and a fourth signal to obtain a second output signal, wherein said fourth signal comprises said second stereo signal modified by a fourth complex function, and wherein said second signal comprises said first stereo signal modified by a second complex function;

wherein said complex functions are functions of said spatial parameters, such that an energy value of the difference between the first signal and the second signal is larger than or equal to the energy value of the sum of the first and the second signal, and such that the energy value of the differencebetween the fourth signal and the third signal is larger than or equal to the energy value of the sum of the fourth signal and the third signal.

11. An encoder apparatus comprising:

an encoder for encoding an N-channel audio signal into spatial parameters and a stereo down-mix signal comprising first and second stereo signals, and a device as claimed in claim 10 for processing the stereo down-mix signal.

12. A method of processing a pre-processed stereo down-mix signal comprising first and second stereo signals, the method comprising:

adding a first signal and a third signal to obtain a first output signal, wherein said first signal comprises said first stereo signal modified by a first complex post-processing function, and wherein said third signal comprises said second stereo signal modified by a third complex post-processing function; and adding a second signal and a fourth signal to obtain a second output signal, wherein said fourth signal comprises said second stereo signal modified by a fourth complex post-processing function and wherein said second signal comprises said first stereo signal modified by a second complex post-processing function;

wherein said complex post-processing functions are derived from complex pre-processing functions used for pre-processing a stereo signal, and wherein said complex post-processing functions are defined such that a pre-processing operation used in pre-processing the stereo signal in accordance with a method of claim 1 is inverted.

13. The method as claimed in claim 12, wherein the steps of adding are implemented in a matrix multiplication $$\begin{bmatrix} L_0 \\ R_0 \end{bmatrix} = \begin{bmatrix} k_1 & k_3 \\ k_2 & k_4 \end{bmatrix} \begin{bmatrix} L_{0w} \\ R_{0w} \end{bmatrix}$$

with

-continued $$k_1 = \frac{1}{g_1 g_4 - g_2 g_3} g_4$$

$$k_2 = \frac{-1}{g_1 g_4 - g_2 g_3} g_2$$

$$k_3 = \frac{-1}{g_1 g_4 - g_2 g_3} g_3$$

$$k_4 = \frac{1}{g_1 g_4 - g_2 g_3} g_1,$$

wherein $L_0$ and $R_0$ are respective first and second output signals, and wherein $L_{0w}$ and $R_{0w}$ are respective first and second stereo input signals, wherein $k_1$, $k_2$, $k_3$ and $k_4$ are said respective first, second, third and fourth complex post-processing functions and wherein $g_1$, $g_2$, $g_3$ and $g_4$ are said respective first, second, third and fourth complex pre-processing functions.

14. A device for processing a pre-processed stereo down-mix signal comprising first and second stereo signals, the device comprising:

a receiver for receiving the pre-processed stereo down-mix signal;

an inverter for inverting a pre-processing operation applied to the stereo down-mix signal received by the receiver to obtain the pre-processed stereo down-mix signal, the inverter being configured for:

adding a first signal and a third signal to obtain a first output signal, wherein said first signal comprises said first stereo signal modified by a first complex post-processing function, and wherein said third signal comprises said second stereo signal modified by a third complex post-processing function; and adding a second signal and a fourth signal to obtain a second output signal, wherein said fourth signal comprises said second stereo signal modified by a fourth complex post-processing function and wherein said second signal comprises said first stereo signal modified by a second complex post-processing function;

wherein said complex post-processing functions are derived from complex pre-processing functions used for pre-processing the stereo down-mix signal, and wherein said complex post-processing functions are defined such that a pre-processing operation used in pre-processing the stereo signal by a device of claim 10 is inverted.

15. The device as claimed in claim 14, wherein the inverter comprises a matrix multiplication $$\begin{bmatrix} L_0 \\ R_0 \end{bmatrix} = \begin{bmatrix} k_1 & k_3 \\ k_2 & k_4 \end{bmatrix} \begin{bmatrix} L_{0w} \\ R_{0w} \end{bmatrix}$$

with $$k_1 = \frac{1}{g_1 g_4 - g_2 g_3} g_4$$

$$k_2 = \frac{-1}{g_1 g_4 - g_2 g_3} g_2$$

$$k_3 = \frac{-1}{g_1 g_4 - g_2 g_3} g_3$$

$$k_4 = \frac{1}{g_1 g_4 - g_2 g_3} g_1,$$

wherein $L_0$ and $R_0$ are respective first and second output signals, and wherein $L_{0w}$ and $R_{0w}$ are respective first and second stereo input signals, wherein $k_1$, $k_2$, $k_3$ and $k_4$ are said respective first, second, third and fourth complex post-processing functions, and wherein $g_1$, $g_2$, $g_3$ and $g_4$ are said respective first, second, third and fourth complex pre-processing functions.

16. A decoder apparatus comprising:

a device as claimed in claim 14 for processing a pre-processed stereo down-mix signal comprising first and second stereo signals to obtain processed stereo signals, and a decoder for decoding the processed stereo signals into an N-channel audio signal.

17. An audio system comprising:

an encoder apparatus, the encoder apparatus comprising:

an encoder for encoding an N-channel audio signal into spatial parameters and a stereo down-mix signal comprising first and second stereo signals, a device for processing a stereo down-mix signal comprising first and second stereo signals, the stereo down-mix signal and associated spatial parameters encoding an N-channel audio signal, the device comprising:

a first adder for adding a first signal and a third signal to obtain a first output signal, wherein said first signal comprises said first stereo signal modified by a first complex function, and wherein said third signal comprises said second stereo signal modified by a third complex function; and a second adder for adding a second signal and a fourth signal to obtain a second output signal, wherein said fourth signal comprises said second stereo signal modified by a fourth complex function, and wherein said second signal comprises said first stereo signal modified by a second complex function;

wherein said complex functions are functions of said spatial parameters, such that an energy value of the difference between the first signal and the second signal is larger than or equal to the energy value of the sum of the first and the second signal, and such that the energy value of the difference between the fourth signal and the third signal is larger than or equal to the energy value of the sum of the fourth signal and the third signal; and a decoder apparatus, the decoder apparatus comprising:

a device as claimed in claim 14 for processing a pre-processed stereo down-mix signal comprising the first output signal and the second output signal to obtain processed stereo signals, and a decoder for decoding the processed stereo signals into an N-channel audio signal.

* * * * *